US005630528A

United States Patent [19]

Nanaji

[11] Patent Number: 5,630,528

[45] Date of Patent: May 20, 1997

[54] METHOD AND APPARATUS FOR METERING AND DISPENSING FLUID, PARTICULARY FUEL

[75] Inventor: Seifollah S. Nanaji, Greensboro, N.C.

[73] Assignee: Gilbarco, Inc., N.C.

[21] Appl. No.: 379,062

[22] Filed: Jan. 27, 1995

[51] Int. Cl.[6] ..... B67B 7/00

[52] U.S. Cl. ..... 222/1; 222/71; 222/134; 222/330

[58] Field of Search ..... 222/1, 23, 25, 222/36, 71, 134, 129, 330

[56] References Cited

U.S. PATENT DOCUMENTS

| | | |
|---|---|---|
| 1,954,906 | 3/1934 | Whitlock . |
| 2,144,465 | 1/1939 | Selleck . |
| 2,320,048 | 5/1943 | Parson . |
| 2,980,294 | 4/1961 | Sacco . |
| 3,199,727 | 8/1965 | Romanowski . |
| 3,705,596 | 12/1972 | Young . |
| 4,223,807 | 9/1980 | Caswell et al. . |
| 4,753,370 | 6/1988 | Rudick . |
| 5,139,045 | 8/1992 | Ensign . |
| 5,163,586 | 11/1992 | Zinsmeyer . |
| 5,203,366 | 4/1993 | Czeck et al. . |

FOREIGN PATENT DOCUMENTS

| | | |
|---|---|---|
| 8104427.4 | 9/1985 | Germany . |
| 1091114 | 11/1967 | United Kingdom . |
| 2165525 | 4/1986 | United Kingdom . |

*Primary Examiner*—Gregory L. Huson
*Attorney, Agent, or Firm*—Kenyon & Kenyon

[57] ABSTRACT

The invention relates to a method and apparatus for dispensing and metering a fluid, particularly fuel, from a plurality of fluid sources to a single or a plurality of fluid outlets. The invention uses a single meter for measuring the amount of fluid dispensed from each of the fluid outlets. Valves are used at the inlet to and outlet from the meter to control the flow of fluid from a single source to a single outlet intended to dispensing fluid from the selected source. The invention is particularly useful in a multiple grade or octane-level fuel pump or dispenser. The meter can advantageously be located near the dispensing nozzles, so that the contamination caused by using a single meter is purged after a small amount of fuel is dispensed. The invention preferably uses a small-volume meter with valves located near the meter, to thereby limit the amount of octane variation caused by use of a single meter.

30 Claims, 8 Drawing Sheets

PRIOR ART.

31
101
90
50
102
103
15
32
33
41
111
42
112
113
43
51
24
52
25
26
31
33
17
71
61
62
72
63
73
53
83
16
18
22''
23''
21''
11
21'
22'
12
23'
1
2
13
3

50
101
102
103
15
90
41
51
24
25
26
33
17
32
71
61
16
31
22''
21''
23''
11
21'
22'
12
23'
13
1
2
3

METHOD AND APPARATUS FOR METERING AND DISPENSING FLUID, PARTICULARY FUEL

BACKGROUND OF THE INVENTION

1. Field of the Invention

The present invention relates to a method and apparatus for metering and dispensing fluids, particularly fuel. The present invention involves a fluid dispenser which receives fluid from more than one source and which dispenses fluid from one or more outlet, with each outlet dispensing fluid from only one of the fluid sources. In particular, the present invention is useful in a lane-oriented multiproduct fuel dispenser or pump.

2. Description of the Related Art

Fuel pumps and fuel dispensers are known in the art. A fuel pump is a unit which is connected to a source of fuel, and which has housed within the unit a pump for extracting fuel from the fuel source, as well as meters for measuring fuel flow and switches and valves for controlling fuel flow. A fuel dispenser, in contrast, is connected to a source of fuel which contains its own pump. As a result, a fuel dispenser does not require that a pump be housed in the unit, and need only contain the appropriate meters, switches and valves for controlling fuel flow.

Fuel pumps or dispensers are designed in a variety of different configurations. A common type of fuel pump or dispenser, often called a "lane-oriented" pump or dispenser, contains one or more fuel dispensing nozzles on each side of the unit. A lane-oriented multiproduct fuel dispenser or pump contains two or more fuel dispensing nozzles on each side of the pump. Each of the nozzles on each side of the unit is typically used to dispense a particular grade or octane level of fuel. Each side of the unit generally contains a display for displaying the amount and cost of the fuel dispensed, and can also include credit or debit card verification and cash acceptance mechanisms.

An example of a fuel dispenser or fuel pump containing multiple-grade fuel sources and multiple fuel outlets for dispensing from those sources is shown in FIG. 1. Fuel sources 1, 2, 3—which can be in the form of underground or above-ground tanks—are connected to source outlet lines 11, 12 and 13, respectively. Each fuel source 1, 2, 3 typically holds a different grade or octane level of fuel. A fuel pump or fuel dispenser unit 50 is used to dispense fuel from the fuel sources 1, 2, 3. If the unit is a fuel dispenser, pumps 21', 22' and 23' are connected to the source outlet lines 11, 12 and 13 respectively, and are located outside of unit 50. If the unit is a fuel pump, pumps 21", 22" and 23" are connected to the source outlet lines 11, 12 and 13 respectively, and are located within a lower housing 18 of unit 50. The pumps 21', 22', 23' or 21", 22", 23" pump fuel to meters 91, 92 and 93 respectively.

Each meter 31, 32, 33 meters fuel flow from one of the fuel sources 1, 2, 3 to nozzles 61, 62, 63, which dispense fuel from the fuel sources 1, 2, 3, respectively. The fuel pump or fuel dispenser can contain an array of nozzles 61, 62, 63 on both sides of the unit 50 to dispense fuel from either side of the unit 50, in which case there will be meters and nozzles on the opposite side identical to those described above. In the device of FIG. 1, the nozzles 61, 62, 63 can be housed in boots 71, 72, 73, which can contain a put-down switch or lever for initializing the display devices 24, 25, 26 when lifted after the nozzle is removed. The put-down switch or lever is lifted by the operator after the nozzles 61, 62, 63 are removed from the boots 71, 72, 73, and are depressed by the nozzles 61, 62, 63 when they are placed back in boots 71, 72, 73. Nozzles 61, 62, 63 contain actuating levers 81, 82, 83 (in FIG. 1 only actuating lever 83 is visible) to manually control the amount of fuel dispensed and rate of dispensing. Unit 50 can contain an upper structure 15, supported on posts 16, 17, to which fuel hoses 51, 52, 53 for nozzles 61, 62, 63 are connected. Connection lines 41, 42, 43 connect the fuel lines in lower housing 18 to the appropriate fuel hose 51, 52, 53. The unit 50 generally contains suitable display devices 24, 25, 26 for displaying volume and dollar amount of fuel dispensed and other information. The unit 50 also often contains suitable credit or debit card verification and/or cash acceptance modules (not shown).

The large number of meters necessary in the prior art device described above greatly increases the costs of manufacturing the unit, increases the required interior volume of the unit, complicates servicing, and creates more potential leakage points for flammable liquid during both operation and servicing.

Fuel pumps and dispensers are regulated by a number of different governmental agencies in the United States, at both the state and federal level. Regulations promulgated by the Environmental Protection Agency limit the number of potential fuel leakage points which can be exposed during assembly or servicing of a fuel pump or fuel dispenser unit. Furthermore, Underwriters' Laboratories, which tests and approves fuel pumps and dispensers, requires more extensive testing when more potential fuel leakage points are contained within the fuel pump or dispenser. In addition, many state Bureaus of Weights and Measures have regulations governing the amount of variation in octane level that a dispensing nozzle for a particular grade of fuel may have, and governing the amount of fuel that may be purged before this variation is measured. For example, the National Office of Weights and Measures promulgates testing regulations on octane variation in particular octane levels of fuel. This variation is measured after a maximum of three-tenths of a gallon has been purged from the dispensing nozzle.

A variety of different meters have been used in prior art fuel pumps and dispensers. Positive displacement meters, used in many older fuel pumps and dispensers, contain a large internal volume, and are of a relatively large external size. As a result of the size of these meters, it is necessary for the meters to be housed in the lower housing of the unit, which contains a relatively large interior volume. In addition, positive displacement meters need to be manually calibrated, therefore requiring them to be housed at a location in the unit having easy access, such as the lower housing of the unit. Inferential meters, which measure fuel flow according to the speed of fuel through the meter, have a much smaller internal volume than the internal volume of a positive displacement meter, and are less affected by the properties of the particular fuel being metered. In addition, inferential meters can be constructed to be electronically self-calibrating or electronically calibrated.

SUMMARY OF THE INVENTION

The present invention is a method and apparatus for dispensing fluid from multiple fluid sources to one or multiple fluid outlets which uses a single meter for monitoring fluid flow from each of the fluid outlets. The single meter contains valves at each fluid inlet and each fluid outlet, to thereby control flow from a particular selected fluid source and to a particular fluid outlet. The invention is particularly useful in a multiple-grade fuel dispenser or fuel pump, which dispenser or pump contains at least one meter for each grade of fuel to be dispensed. Valves are located at all inlet points to, and may be at all outlet points from, the meter. These valves are operated to control the flow of fuel from one of the fuel sources into the meter, and the flow of fuel from the meter to the selected dispensing nozzle. The invention is particularly useful in increasing the available space in the interior of the housing for a fuel dispenser or fuel pump unit. A small size meter, such as an inferential meter, advantageously may be used in the present invention as the single meter for multiple grades of fuel. Such a meter, which is small, lightweight, and can be electronically calibrated or self-calibrating, can be located in the upper structure of the fuel pump or fuel dispenser, thereby freeing up more space in the interior of the housing of the unit. This design also allows any fuel contamination resulting from the use of a single meter to be located closely adjacent to the fuel outlet nozzle, ensuring that the contamination will be purged from the outlet after a small volume of fuel flow. As a result, the invention can comply with regulations for octane level variation without the need for multiple, redundant meters.

By eliminating multiple, redundant flow meters, the present invention also reduces the number of potential leakage points, therefore increasing safety during both operation and servicing. The invention includes a valving arrangement which allows a minimal amount of contamination. In order to comply with regulations relating to octane variation of the dispensed fuel, the single meter of the present invention can be advantageously located in the upper structure of a fuel pump or dispenser, or closely adjacent the dispensing nozzle. The present invention is particularly useful in fuel pump units, to reduce the number of components which must be placed within the lower housing of the unit.

DETAILED DESCRIPTION OF THE INVENTION

Figure 1:
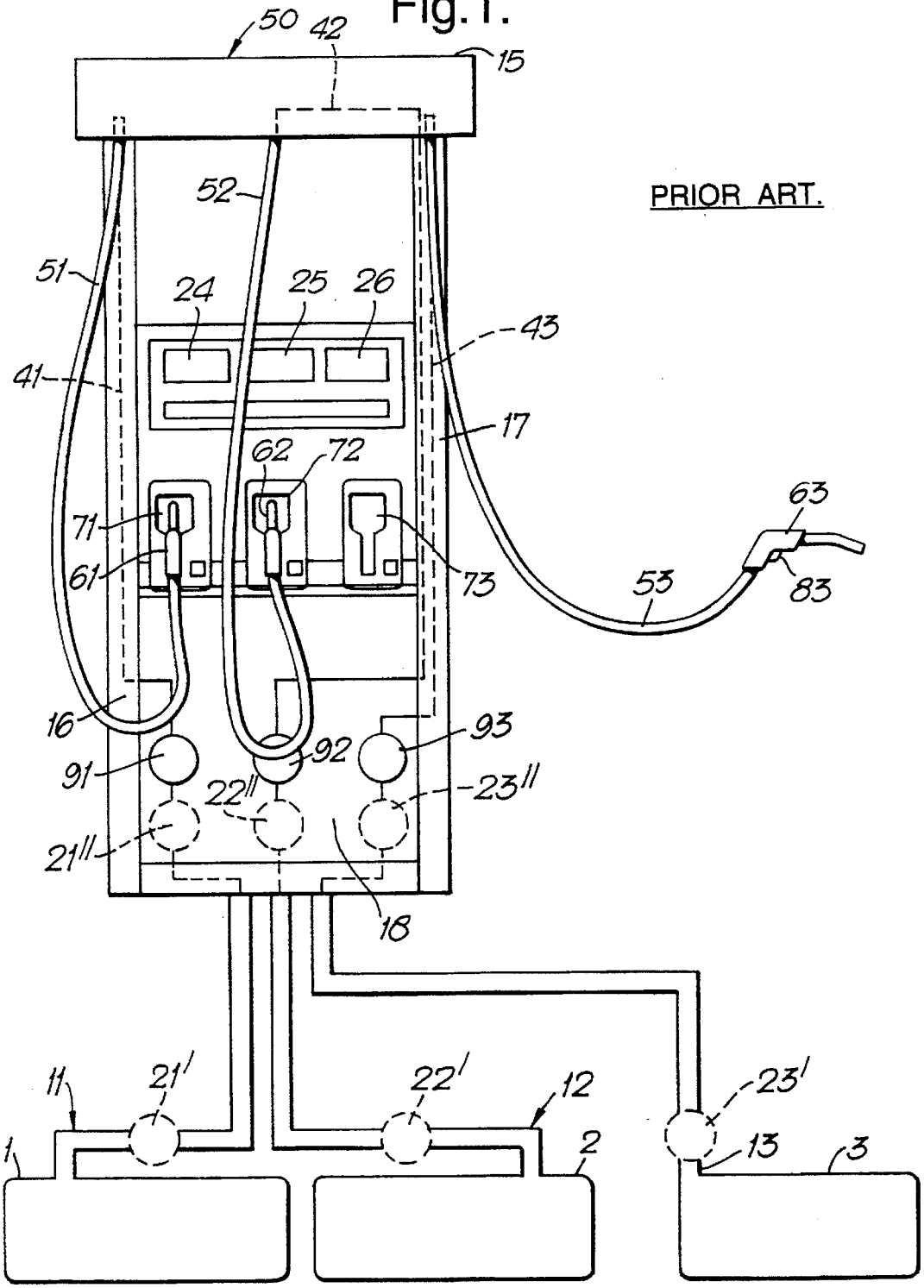
FIG. 1 shows a prior art fuel pump or dispenser using multiple meters.
Figure 2:
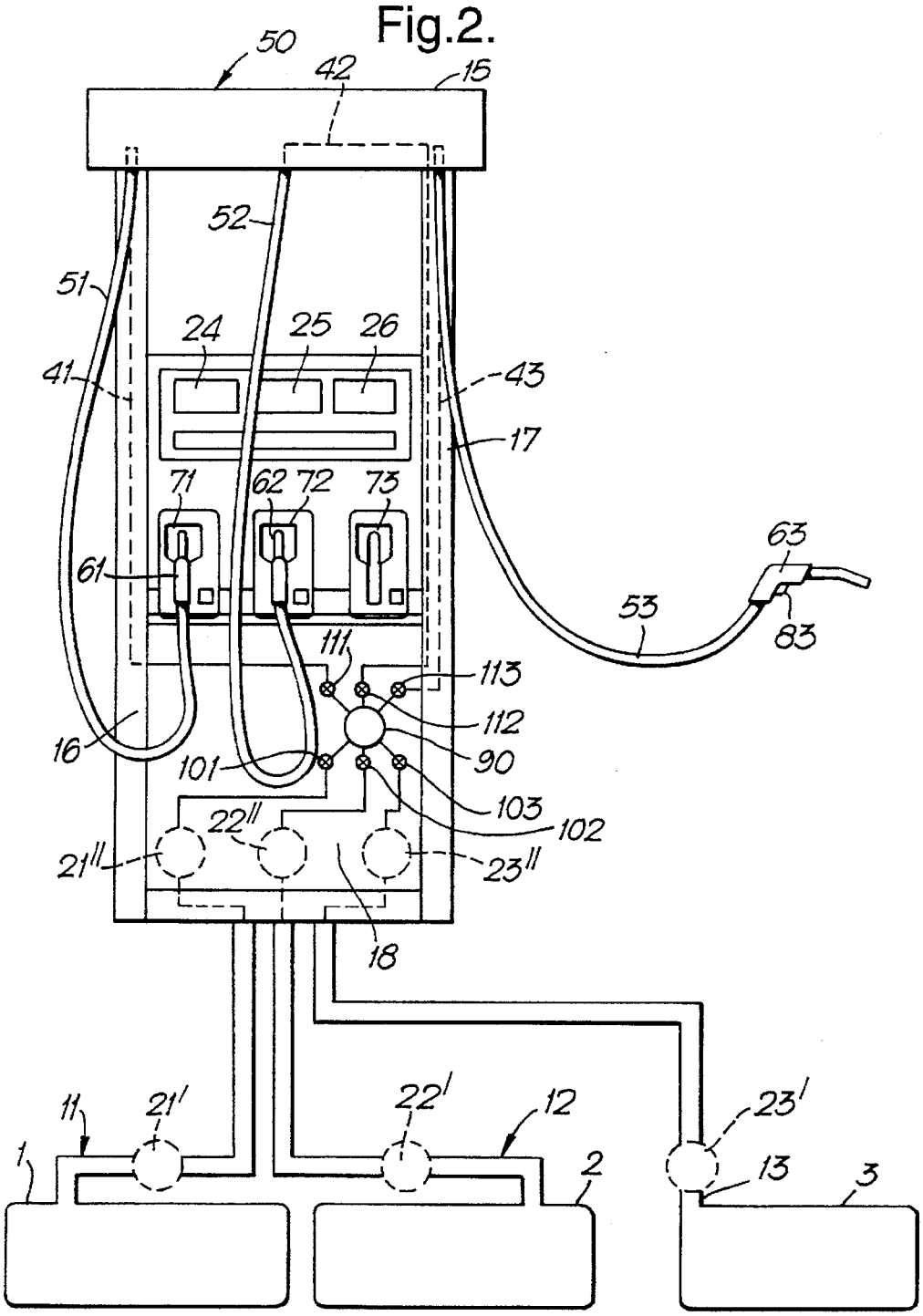
FIG. 2 shows a fuel pump or dispenser according to a first embodiment of the present invention.
Figure 3:
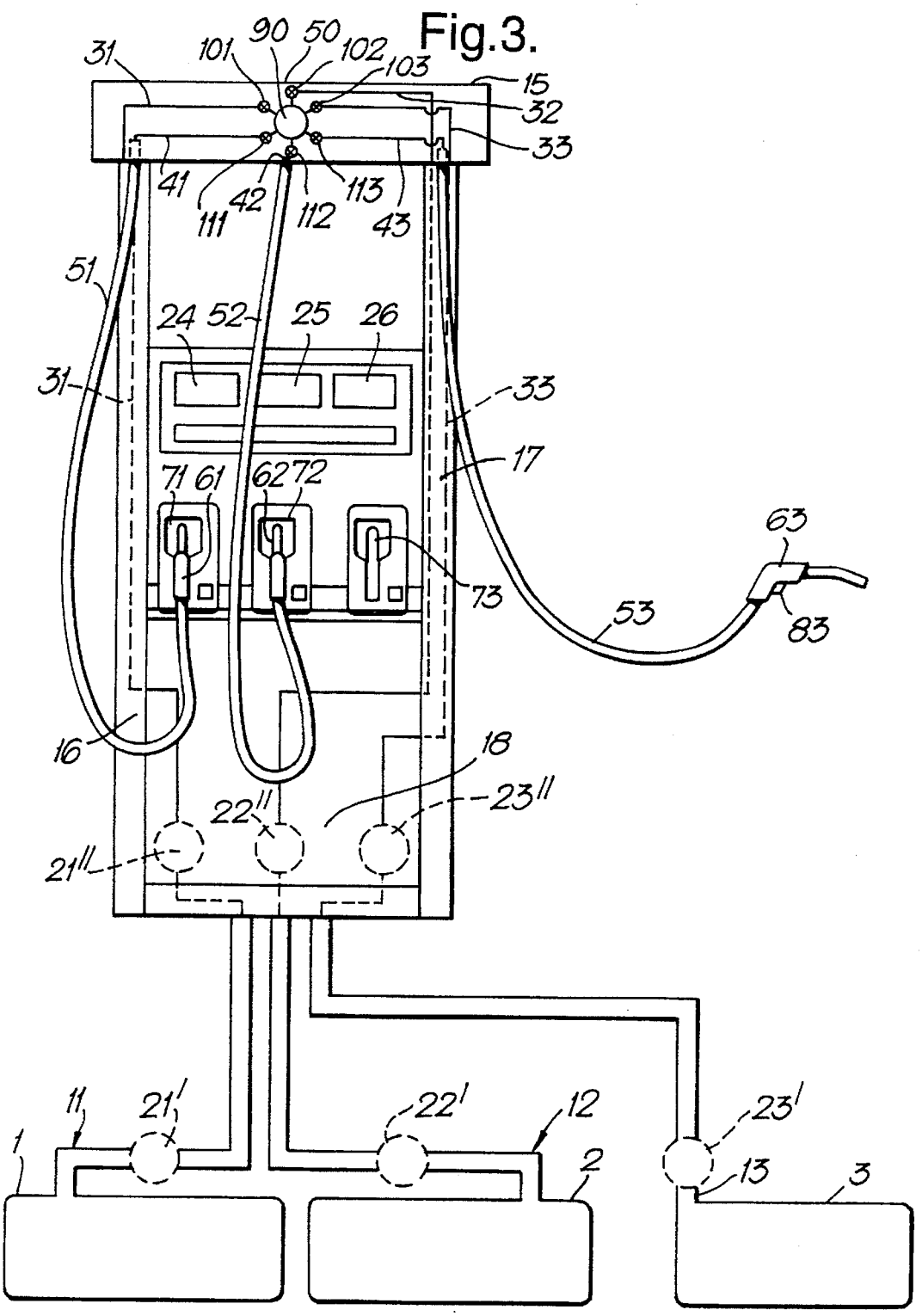
FIG. 3 shows a fuel pump or dispenser according to a second embodiment of the present invention.
Figure 4:
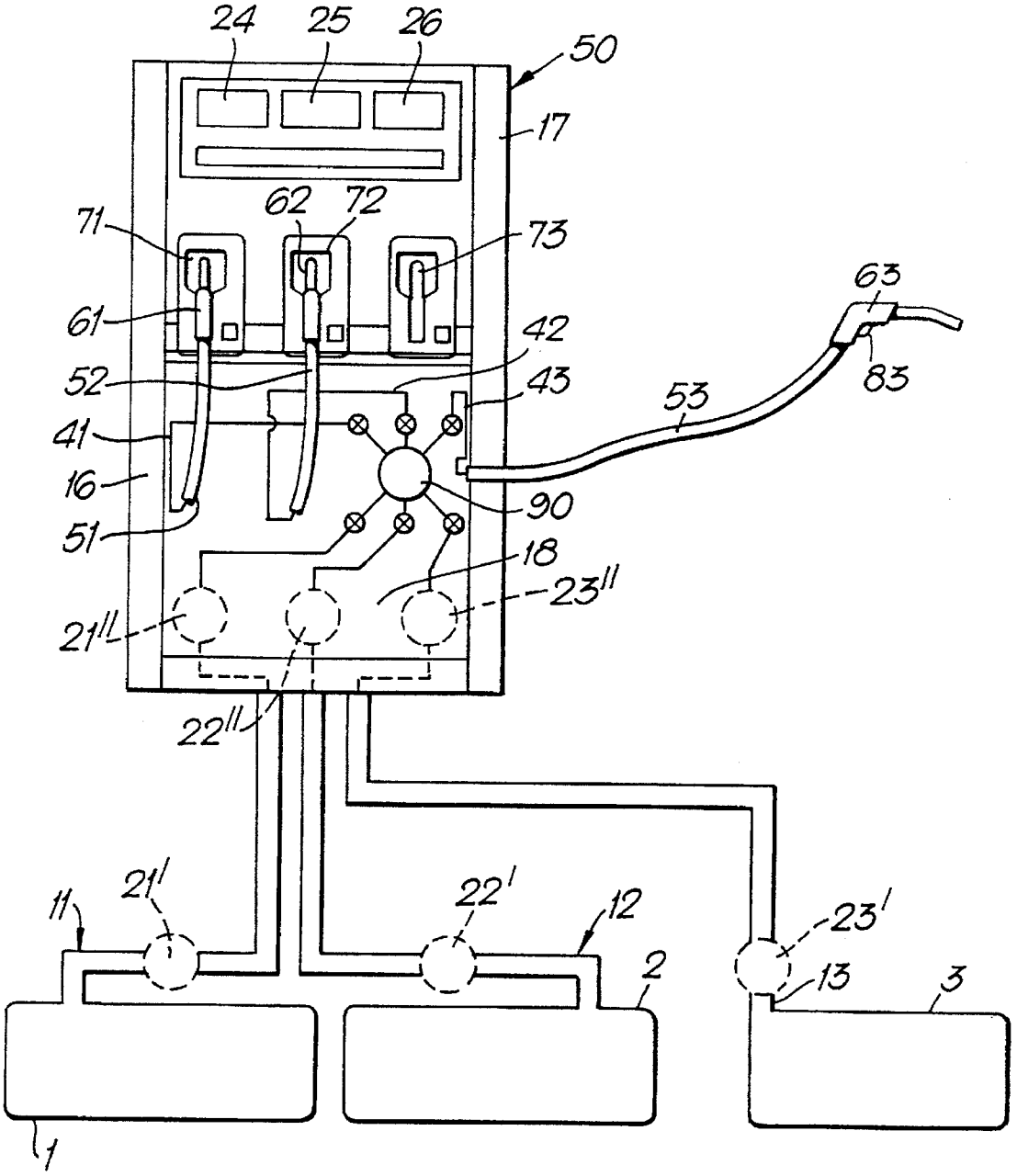
FIG. 4 shows a fuel pump or dispenser according to a third embodiment of the present invention.

FIG. 2 shows a first embodiment of the present invention, in which the single meter 90 is contained in the lower housing 18 of the fuel pump or dispenser unit 50. In the embodiments of FIGS. 2–4, identical structure to the device of FIG. 1 is labelled with identical reference numerals, and is not separately described. Located between pumps 21' or 21", 22' or 22", 23' or 23" and meter 90 are meter inlet valves 101, 102, 103. Meter inlet valve 101 controls the flow of fuel from fuel source 1 to meter 90, meter inlet valve 102 controls the flow of fuel from fuel source 2 to meter 90, and meter inlet valve 103 controls the flow of fuel from fuel source 3 to meter 90. Located between meter 90 and connection lines 41, 42, 43 are meter outlet valves 111, 112, 113. Meter outlet valve 111 controls the flow of fuel from meter 90 to connection line 41, meter outlet valve 112 controls the flow of fuel from meter 90 to connection line 42, and meter outlet valve 113 controls the flow of fuel from meter 90 to connection line 43. All of valves 101, 102, 103, 111, 112, 113 are connected to a controlling device 200 (shown in FIG. 5), preferably in the form of the microprocessor, which controls the opening and closing of the valves to ensure that fuel flows into the meter from only one source and out of the meter to only one connection line. Furthermore, the controlling device 200 ensures that fuel flows only from a fuel source 1, 2, 3 to its corresponding dispensing nozzle 61, 62, 63.

In operation of the device, an operator selects a desired grade of fuel by lifting a nozzle 61, 62, 63 from its boot 71, 72, 73. As shown in FIG. 2, the nozzle 63 has been lifted from its boot 73. The operator then lifts a put-down switch or lever, generally located in boot 73, which initializes the pump display and measuring systems. As is known in the art, the operator may initiate credit or debit verification, cash acceptance, or fuel presets before operating the put-down switch or lever. Operation of the put-down switch or lever causes the controlling device 200 to send signals to the valves 101, 102, 103, 111, 112, 113 to open and close the appropriate valves. Thus, operation of the put-down switch or lever in boot 73 sends a signal to the controlling device 200 that fuel from fuel source 3 is to be dispensed out nozzle 63. As a result, the controlling device 200 closes valves 101, 102, 111, 112 and opens valves 103, 113. Activation by the operator of actuating lever 83 commences fuel dispensing from nozzle 63.

Fuel is pumped by either pump 23' or 23" from source 3 through open valve 103, meter 90, open valve 113, connecting line 43, hose 53 and out nozzle 63. Signals from meter 90 resulting from fuel flow through meter 90 are sent to the display devices 24, 25, 26 on unit 50 and also to any known pump control console station within the gas station which monitors fuel sales. Once dispensing is finished, nozzle 63 is replaced in boot 73, thereby deactivating the put-down switch or lever in boot 73. If it is desired to dispense a different grade of fuel, the appropriate nozzle 61, 62 is lifted, the appropriate put-down switch or lever is actuated, and the valves, 101, 102, 103, 111, 112, 113 are closed or opened to control the dispensing of the desired grade of fuel.

As a result of the above-described operation, only the volume between valves 101, 102, 103 and valves 111, 112, 113 contains a volume of fuel which could contaminate a subsequently-dispensed fuel flow. It is therefore advantageous that valves 101, 102, 103, 111, 112, 113 be located as close as possible to the meter 90, to thereby reduce the volume of possible contaminating fuel contained in a dispensed quantity of fuel. The meter 90, in accordance with the principles of the present invention, monitors the volume of fuel dispensed for each of the sources of fuel 1, 2, 3 and sends signals to the display and monitoring device each time fuel is dispensed, no matter what grade.

FIG. 3 shows a second embodiment of the present invention, wherein the meter 90 is located in the upper structure 15. As can be seen in FIG. 3, the embodiment of FIG. 3 is identical to the embodiment of FIG. 2, except that the meter 90 is placed within upper structure 15. Connecting lines 31, 32, 33 connect the fuel lines in the lower housing 18 of unit 50 with the valves 101, 102, 103, and connecting lines 41, 42, 43 connect the valves 111, 112, 113 with the hoses 51, 52, 53. In the embodiment of FIG. 3, the valves 101, 102, 103, 111, 112, 113 are also located within upper structure 15 and in close proximity to the meter 90. The embodiment of FIG. 3 is particularly advantageous in that it reduces the volume of fuel which is dispensed before the contaminating volume is dispensed—i.e., it places the location of the contaminating fuel closely adjacent to the outlets, nozzles 61, 62, 63. In this way, the contaminating fuel may be purged from the fuel line after only a small volume of fuel has been dispensed. As a result, the embodiment of FIG. 3 is advantageous in conforming to regulations for fuel octane variations and the volume that may be purged before such variation is measured.

The embodiment of FIG. 3 advantageously could use a electronically-calibrated or self-calibrating inferential meter, or any other type of meter which is of small size and weight and which does not require manual calibration. Such a meter is not required to be housed within a large interior volume and does not require easy access for a technician to calibrate.

FIG. 4 shows an embodiment similar to the embodiment of FIG. 2, but which is used in a fuel pump or fuel dispensing unit 50 without an upper structure. In all other respects, the construction of the embodiment of FIG. 4 and the embodiment of FIG. 2 are the same. The embodiment of FIG. 4 retains the same advantages as the embodiment of FIG. 3, in that it allows the meter 90 to be located closely adjacent the nozzles 61, 62, 63, thereby allowing the fuel contamination in meter 90 to be purged from the dispensing nozzle 61, 62, 63 after only a small volume of fuel has been dispensed. It is to be understood that FIG. 4 is schematic in nature, and that the connections between connection lines 41, 42, 43 and hoses 51, 52, 53 are shown for ease of reference. As in most conventional non-upper-structured fuel dispenser or fuel pump units, the actual connection between connection lines 41, 42, 43 and hoses 51, 52, 53 is accomplished at the bottom of the lower housing 18.

Figure 5:
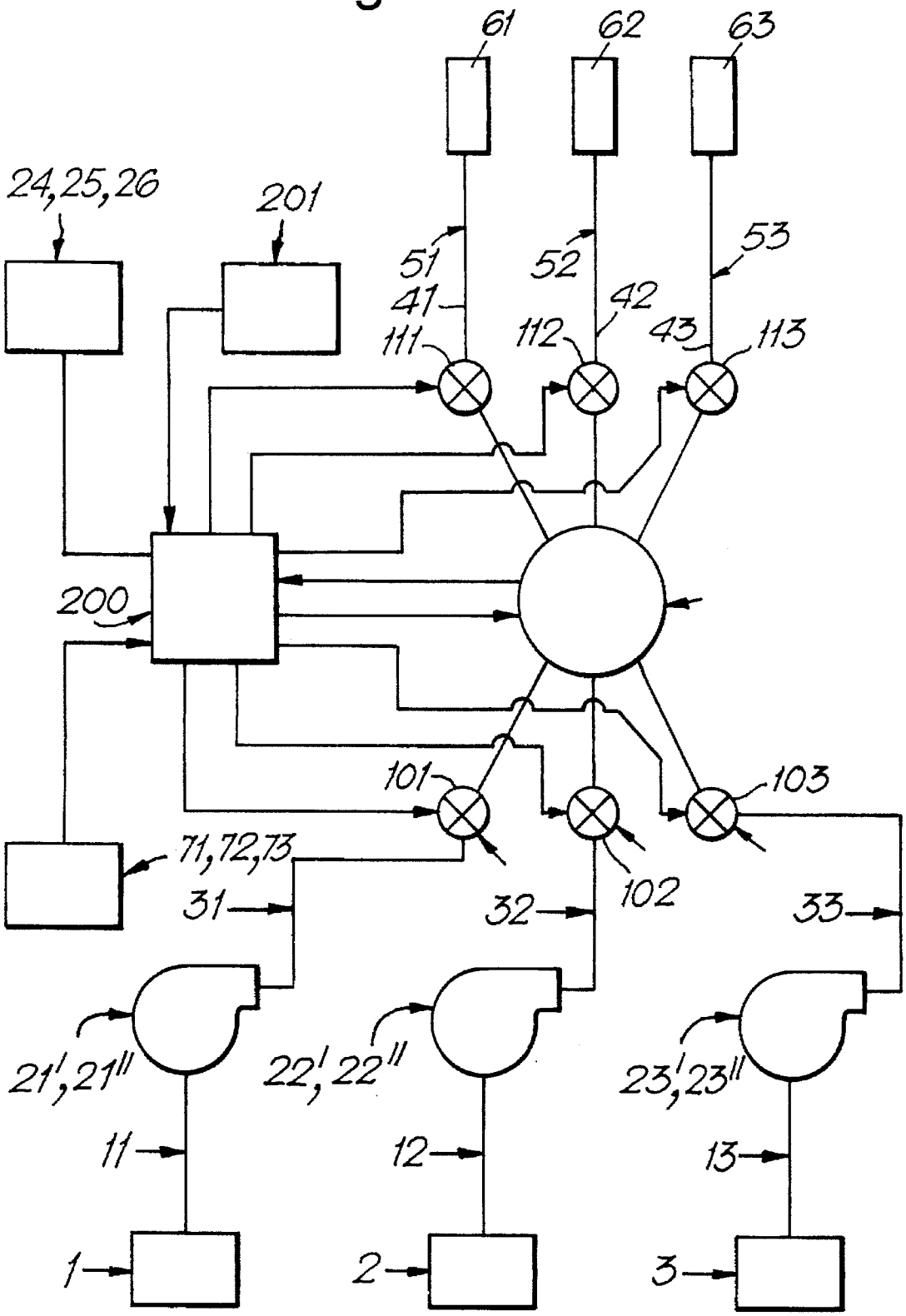
FIG. 5 shows a schematic representation of each of the embodiments of FIGS. 2–4.

FIG. 5 is a schematic representation of each of the embodiments of FIGS. 2–4 of the present invention. Fuel from sources 1, 2, 3 is pumped through lines 11, 12, 13 by pumps 21' or 21", 22' or 22", 23' or 23", respectively. Fuel is pumped through connection lines 31, 32, 33 to valves 101, 102, 103. Each valve 101, 102, 103 is connected to an inlet to meter 90. An outlet of meter 90 is connected to valves 111, 112, 113, which in turn are connected to connection lines 41, 42, 43 and hoses 51, 52, 53, respectively. Hoses 51, 52, 53 are connected to nozzles 61, 62, 63 respectively.

A controlling device 200, which may be in the form of a microprocessor, sends signals to valves 101, 102, 103, 111, 112, 113 to open and close these valves. The signals to valves 101, 102, 103, 111, 112, 113 are responsive to signals sent to controlling device 200 from put-down switches or levers in boots 71, 72, 73. Controlling device 200 can send signals to meter 90 to calibrate that meter, and receives signals from meter 90 corresponding to an amount of fluid dispensed by a nozzle 61, 62, 63. Controlling device 200 sends signals to display devices 24, 25, 26 corresponding to the amount of fuel dispensed and other information, and can receive signals from a credit or debit verification module or cash acceptance module 201.

Each of the embodiments can be used in a lane-oriented multiproduct dispenser. Accordingly, on the opposite side of the fuel pump or dispenser unit would be a second set of dispensing nozzles and hoses. These nozzles or hoses would be connected to another single meter for measuring flow to each of the nozzles. The meter would be connected to each of the fuel sources 1, 2, 3, and a pump would pump fuel to the meter. The structure of the opposite side of the lane-oriented multiproduct dispenser would be identical to that shown in FIGS. 2, 3 or 4 and would be identical to the schematic representation in FIG. 5.

Figure 6:
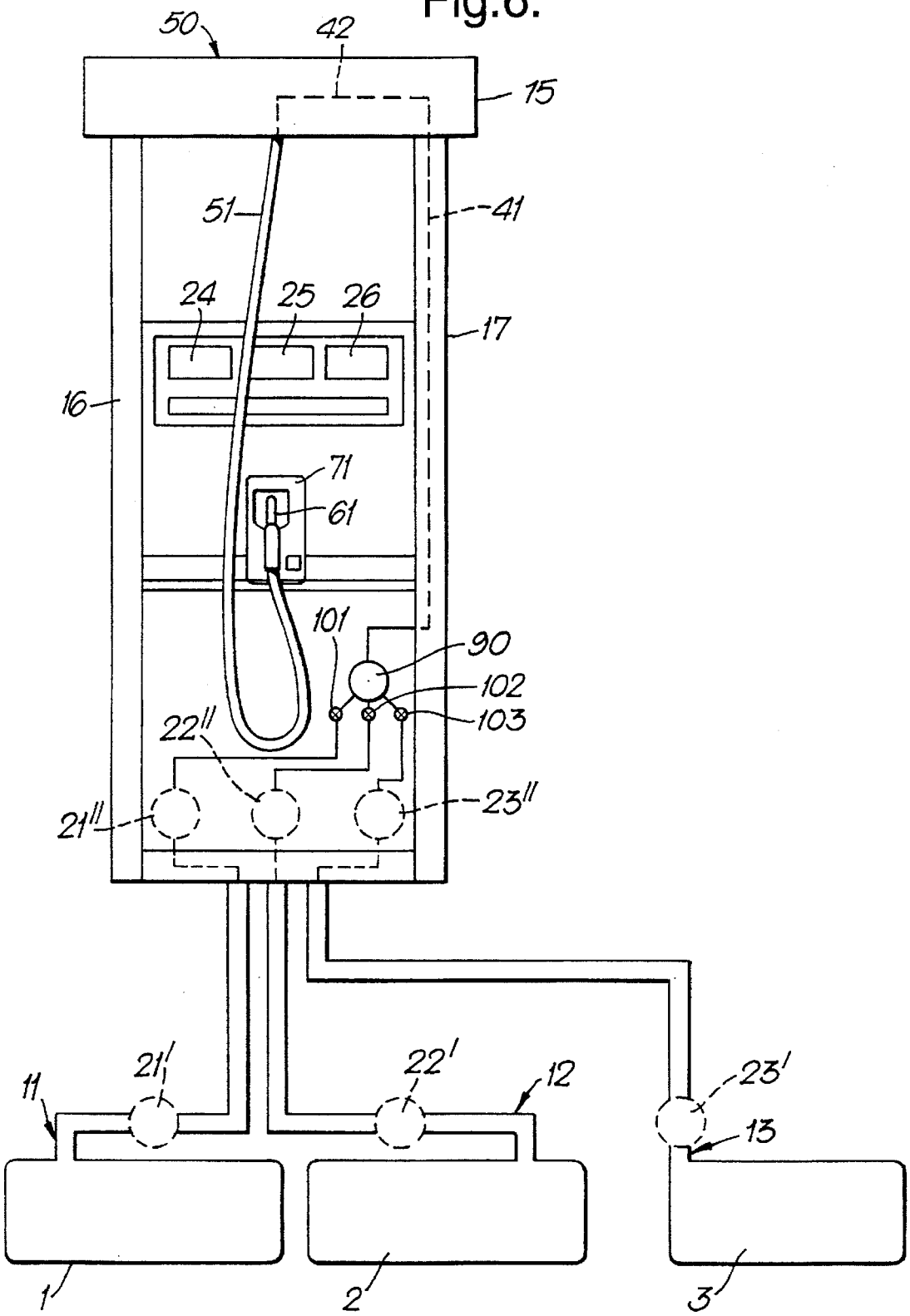
FIG. 6 shows a fuel pump or dispenser according to a fourth embodiment of the present invention.

FIG. 6 shows a fourth embodiment of the present invention. The embodiment of FIG. 6 is similar to the embodiment of FIG. 2, except that a single nozzle 61 and a single hose 51 are used to discharge fuel from each of fuel sources 1, 2, 3. Accordingly, a single connection line 41 leads from meter 90 to the single hose 51. This embodiment does not require the use of valves on the outlet of meter 90; valves 101, 102, 103 control the flow of fuel through the meter 90 and to the nozzle 61. In all other respects, however, the embodiment of FIG. 6 is identical to that of the embodiment of FIG. 2.

Figure 7:
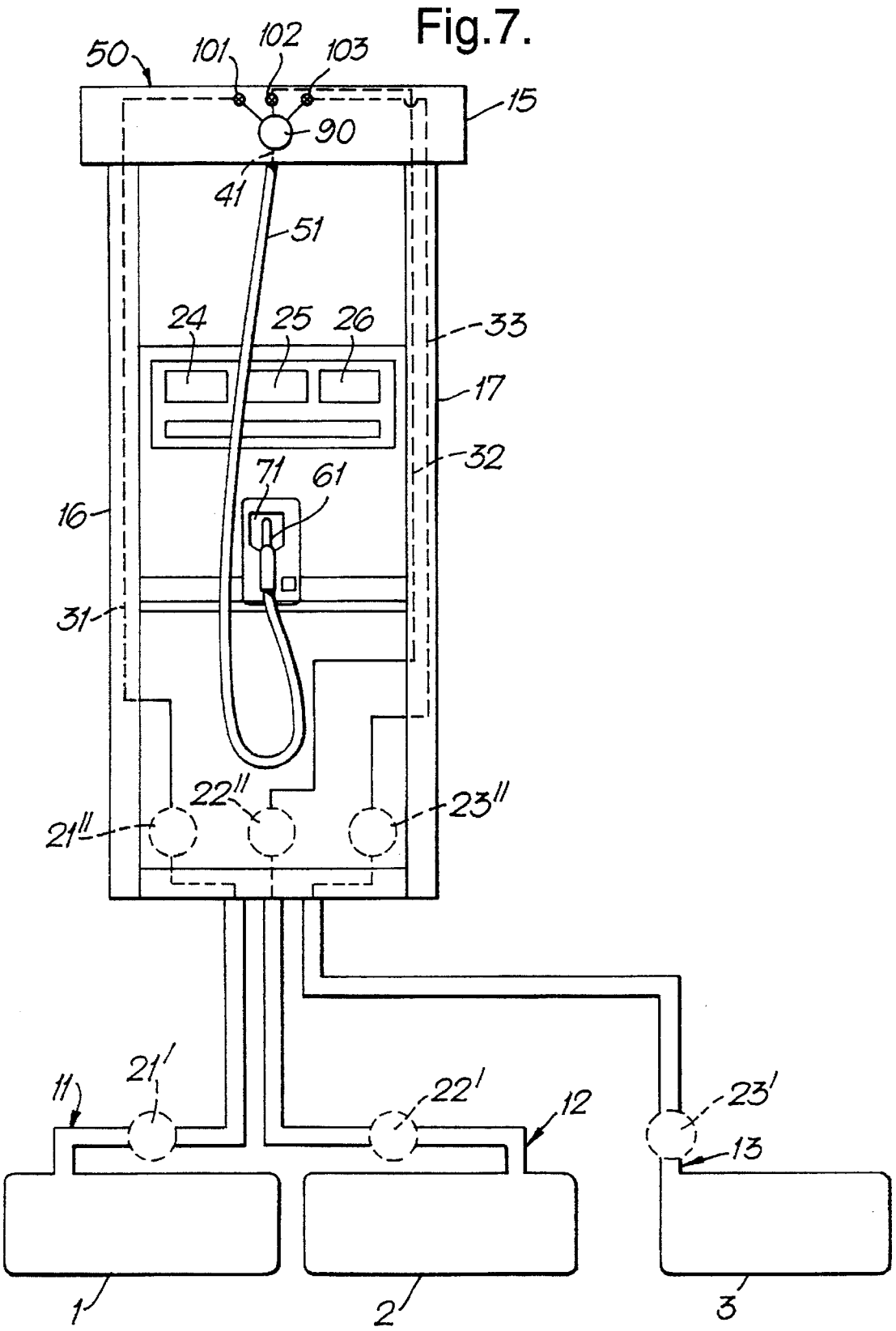
FIG. 7 shows a fuel pump or dispenser according to a fifth embodiment of the present invention.

FIG. 7 shows a fifth embodiment of the present invention, which is similar to the embodiment of FIG. 3, except that a single nozzle 61 and a single hose 51 are used to discharge fuel from each of fuel sources 1, 2, 3. Accordingly, a single connection line 41 leads from meter 90 to the single hose 51. This embodiment does not require the use of valves on the outlet of meter 90; valves 101, 102, 103 control the flow of fuel through the meter 90 and to the nozzle 61. In all other respects, however, the embodiment of FIG. 7 is identical to that of the embodiment of FIG. 3. A further embodiment, not illustrated, is also possible, which is similar to the embodiments of FIGS. 6 and 7—i.e., it uses a single hose and a single nozzle—but is in the fuel dispenser or fuel pump configuration of FIG. 4—i.e., the connection between the single hose and the single connection line is at the lower housing of the unit. The operation of this embodiment would be identical to the operation of the embodiment of FIGS. 6 and 7.

Figure 8:
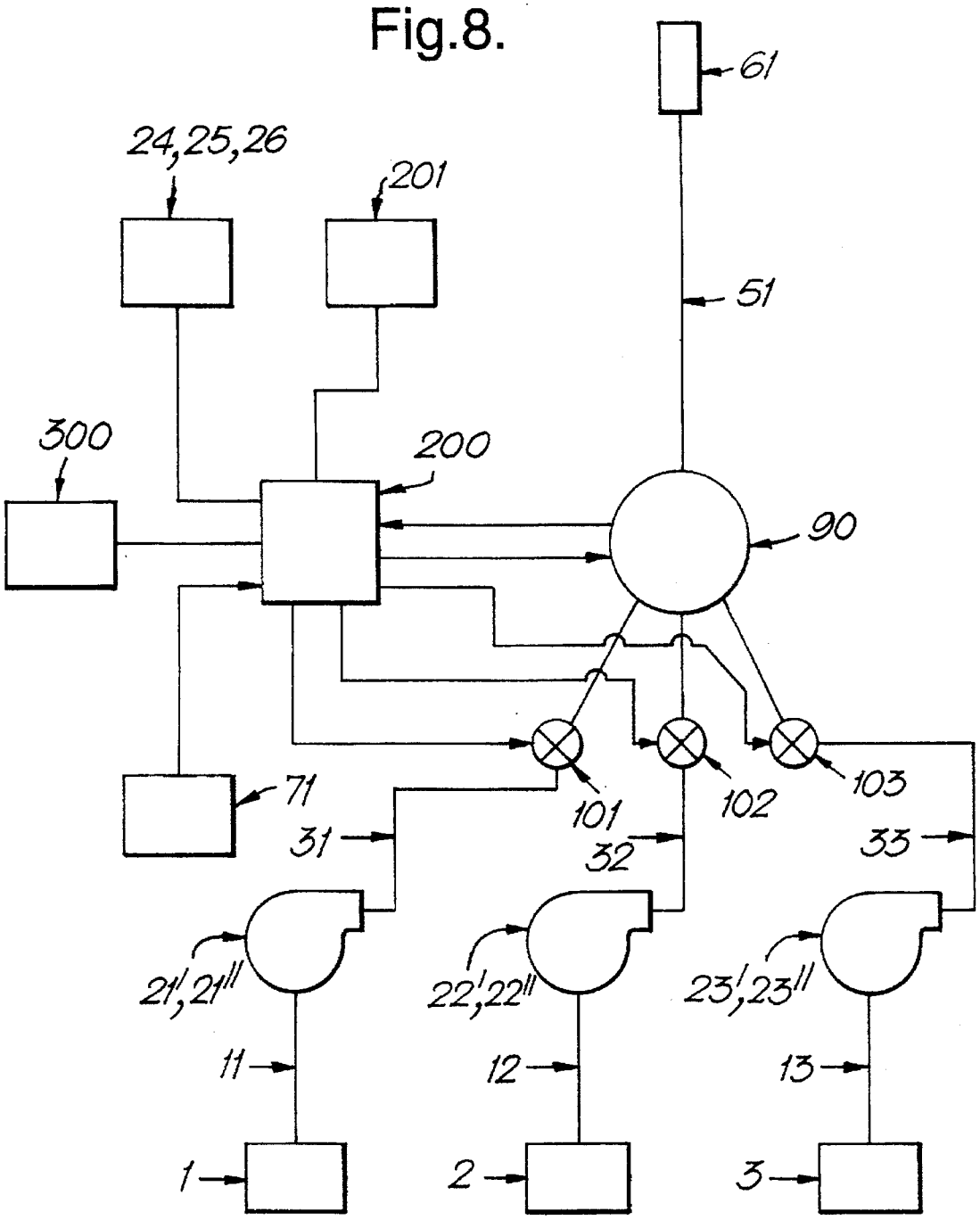
FIG. 8 shows a schematic representation of each of the embodiments of FIGS. 6–7.

FIG. 8 is a schematic representation of each of the embodiments of FIGS. 6–7 of the present invention. Fuel from sources 1, 2, 3 is pumped through lines 11, 12, 13 by pumps 21' or 21", 22' or 22", 23' or 23", respectively. Fuel is pumped through connection lines 31, 32, 33 to valves 101, 102, 103. Each valve 101, 102, 103 is connected to an inlet to meter 90. An outlet of meter 90 is connected to connection line 41 and hose 51. Hose 51 is connected to nozzle 61.

A controlling device 200, which may be in the form of a microprocessor, sends signals to valves 101, 102, 103 to open and close these valves. The signals to valves 101, 102, 103 are responsive to signals sent to controlling device 200 from the put-down switch or lever in boot 71 and fuel grade selection buttons or switches 300 on the unit, which are activated by a user to select the grade of fuel which is to be dispensed. Controlling device 200 can send signals to meter 90 to calibrate that meter, and receives signals from meter 90 corresponding to an amount of fluid dispensed by nozzle 61. Controlling device 200 sends signals to display devices 24, 25, 26 corresponding to the amount of fuel dispensed and other information, and can receive signals from a credit or debit verification module or cash acceptance module 201.

It is to be understood that many variations are possible under the teachings of the present disclosure. For example, it is not necessary that the meter or meters of the present invention be housed in the pump or dispenser unit, and could be located remote from the unit itself. The present invention is not limited by the particular structures and methods described above, but is instead defined by the claims below.

I claim:

1. An apparatus for dispensing fluids comprising:

a plurality of fluid sources;

at least one fluid outlet;

a meter, each of said plurality of fluid sources being in fluid communication with said meter, said meter measuring the amount of fluid discharged through said at least one fluid outlet;

a plurality of valves, said plurality of valves controlling a flow of fluid from said plurality of fluid sources through said meter to said at least one fluid outlet; and a controlling device, said controlling device controlling said plurality of valves whereby said flow of fluid comprises flow from only one of said plurality of fluid sources and to only said at least one fluid outlet.

2. The apparatus of claim 1, further comprising:

a plurality of pumps, each of said plurality of pumps pumping fluid from one of said plurality of fluid sources.

3. The apparatus of claim 1, further comprising:

a display device, said display device displaying information corresponding to measurements made by said meter.

4. The apparatus of claim 1, wherein: said plurality of valves are located adjacent said meter.

5. The apparatus of claim 1, wherein:

said meter is located adjacent said at least one fluid outlet.

6. An apparatus for dispensing fuel comprising:

a plurality of fluid sources;

at least one fuel discharge nozzle;

a meter, each of said plurality of fuel sources being in fluid communication with said meter and said at least one fuel discharge nozzle being in fluid communication with said meter, said meter measuring the amount of fuel discharged through said at least one fuel discharging nozzle;

a plurality of valves, said plurality of valves controlling a flow of fuel from said plurality of fuel sources to said at least one fuel discharge nozzle; and a controlling device, said controlling device controlling said plurality of valves whereby said flow of fuel comprises flow from only one of said plurality of fuel sources and to only said at least one fuel discharge nozzle.

7. The apparatus of claim 6, further comprising:

a display device, said display device displaying information corresponding to measurements made by said meter.

8. The apparatus of claim 6, wherein:

said plurality of valves are located adjacent said meter.

9. The apparatus of claim 6, wherein:

said meter is located adjacent said at least one fluid discharge nozzle.

10. The apparatus of claim 6, further comprising:

a housing unit, said housing unit comprising an upper structure, said meter being located in said upper structure.

11. The apparatus of claim 6, wherein:

said meter is an inferential meter.

12. The apparatus of claim 6, wherein:

said meter is a positive-displacement meter.

13. The apparatus of claim 6, wherein:

said meter is self-calibrating.

14. The apparatus of claim 6, wherein:

said meter is electronically calibrated.

15. The apparatus of claim 6, further comprising:

at least one second fuel discharge nozzle;

a housing unit, said at least one fuel discharge nozzle being located on a first side of said housing unit and said at least one second fuel discharge nozzle being located on a second side of said housing unit;

a second meter, each of said plurality of fuel sources being in fluid communication with said second meter and said at least one second fuel discharge nozzle being in fluid communication with said second meter, said second meter measuring the amount of fuel discharged through said at least one second fuel discharge nozzle; and a second plurality of valves, said second plurality of valves controlling a flow of fuel from said plurality of fuel sources to said at least one second fuel discharge nozzle.

16. The apparatus of claim 15, further comprising:

a plurality of second fuel discharge nozzles, each of said second fuel discharge nozzles discharging fuel from only one of said fuel sources.

17. The apparatus of claim 6, further comprising:

a plurality of pumps, each of said plurality of pumps pumping fuel from one of said plurality of fuel sources.

18. The apparatus of claim 17, further comprising:

a fuel pump unit housing, said plurality of pumps being housed within said fuel pump unit housing.

19. The apparatus of claim 17, further comprising:

a fuel dispenser unit housing, said plurality of pumps being housed outside said fuel dispenser unit housing.

20. A method for dispensing fuel comprising the steps of:

providing a plurality of fuel sources;

providing at least one fuel discharge nozzle;

extracting fuel from said plurality of fuel sources;

passing all fuel extracted from each of said plurality of sources through a single meter; and dispensing fuel passed through said meter from said at least one fuel discharge nozzle.

21. The method of claim 20, wherein:

said step of extracting fuel from said plurality of fuel sources comprises pumping fuel from one of said plurality of fuel sources.

22. The method of claim 20, further comprising the steps of:

providing a plurality of valves;

controlling said plurality of valves whereby fuel flows from only one of said plurality of fuel sources and to only said at least one fuel discharge nozzle.

23. The method of claim 20, further comprising the step of:

displaying information corresponding to measurements made by said meter.

24. The method of claim 20, further comprising the steps of:

providing at least one second fuel discharge nozzle, said at least one second fuel discharge nozzle discharging fuel from only one of said fuel sources;

providing a housing unit;

locating said at least one fuel discharge nozzle on a first side of said housing unit and locating said at least one second fuel discharge nozzle on a second side of said housing unit;

extracting fuel from said plurality of fuel sources;

passing fuel extracted from each of said second plurality of sources through a second meter;

dispensing fuel passed through said second meter from said at least one second discharge nozzle.

25. The method of claim 20 wherein:

said step of providing at least one fuel discharge nozzle comprises providing a plurality of fuel discharge nozzles, each of said plurality of fuel discharge nozzles discharging fuel from only one of said fuel sources; and further comprising the step of controlling a flow of fuel from said fuel sources such that fuel extracted from one of said fuel sources is dispensed at only one of said fuel discharge nozzles.

26. An apparatus for dispensing fluids comprising:

a plurality of fluid sources;

a plurality of fluid outlets, each of said plurality of fluid outlets discharging fluid from only one of said fluid sources;

a meter, each of said plurality of fluid sources being in fluid communication with said meter, said meter measuring the amount of fluid discharged through said plurality of fluid outlets; and a plurality of valves, said plurality of valves controlling a flow of fluid from said plurality of fluid sources through said meter to said fluid outlets.

27. An apparatus for dispensing fuel comprising:

a plurality of fluid sources;

a plurality of fuel discharge nozzles, each of said plurality of fuel discharge nozzles discharging fuel from only one of said fuel sources;

a meter, each of said plurality of fuel sources being in fluid communication with said meter and said plurality of fuel discharge nozzles being in fluid communication with said meter, said meter measuring the amount of fuel discharged through said plurality of fuel discharging nozzles; and a plurality of valves, said plurality of valves controlling a flow of fuel from said plurality of fuel sources to said plurality of fuel discharge nozzles.

28. A method for dispensing fuel comprising the steps of:

providing a plurality of fuel sources;

providing at least one fuel discharge nozzle and at least one second fuel discharge nozzle;

providing a housing unit;

locating said at least one fuel discharge nozzle on a first side of said housing unit and locating said at least one second fuel discharge nozzle on a second side of said housing unit;

extracting fuel from said plurality of fuel sources;

passing all fuel extracted from each of said plurality of sources through either a first meter or a second meter; and dispensing fuel passed through said first meter from said at least one fuel discharge nozzle and dispensing all fuel passed through said second meter from said at least one second fuel discharge nozzle.

29. The method of claim 28, wherein:

said step of providing at least one fuel discharge nozzle comprises providing a plurality of fuel discharge nozzles, each of said plurality of fuel discharge nozzles discharging fuel from only one of said fuel sources; and further comprising the step of controlling a flow of fuel from said fuel sources such that fuel extracted from one of said fuel sources is dispensed at only one of said fuel discharge nozzles; and wherein:

said step of providing at least one second fuel discharge nozzle comprises providing a plurality of, second fuel discharge nozzles, each of said plurality of second fuel discharge nozzles discharging fuel from only one of said fuel sources; and further comprising the step of controlling a flow of fuel from said fuel sources such that fuel extracted from one of said fuel sources is dispensed at only one of said second fuel discharge nozzles.

30. A method for dispensing fuel comprising the steps of:

providing a plurality of fuel sources;

providing a plurality of fuel discharge nozzles, each of said plurality of fuel discharge nozzles discharging fuel from only one of said fuel sources;

extracting fuel from said plurality of fuel sources;

controlling a flow, of fuel from said fuel sources such that fuel extracted from one of said fuel sources is dispensed at only one of said fuel discharge nozzles;

passing fuel extracted from each of said plurality of sources through a single meter; and dispensing fuel passed through said meter from said at least one fuel discharge nozzle.

* * * * *

US005630528C1

(12) EX PARTE REEXAMINATION CERTIFICATE (5329th)

United States Patent
Nanaji

(10) Number: US 5,630,528 C1
(45) Certificate Issued: Apr. 11, 2006

(54) METHOD AND APPARATUS FOR METERING AND DISPENSING FLUID, PARTICULARLY FUEL

(75) Inventor: Seifollah S. Nanaji, Greensboro, NC (US)

(73) Assignee: Marconi Commerce Systems Inc., Greensboro, NC (US)

Reexamination Request:
No. 90/005,896, Dec. 27, 2000

Reexamination Certificate for:

| | |
|---|---|
| Patent No.: | **5,630,528** |
| Issued: | **May 20, 1997** |
| Appl. No.: | **08/379,062** |
| Filed: | **Jan. 27, 1995** |

(51) Int. Cl.
*B67B 7/00* (2006.01)

(52) U.S. Cl. ..... 222/1; 222/71; 222/134; 222/330; 222/26

(58) Field of Classification Search ..... 222/1, 222/23, 25, 36, 71, 129, 134, 330, 26, 28, 222/55, 56, 132, 135, 136, 144.5, 145.1; 141/1, 98, 231
See application file for complete search history.

(56) References Cited

U.S. PATENT DOCUMENTS

| | | | | | |
|---|---|---|---|---|---|
| 1,954,906 | A | * | 4/1934 | Whitlock | 222/30 |
| 1,973,677 | A | * | 9/1934 | Woodford | 222/36 |
| 2,241,286 | A | | 5/1941 | Werts | 73/200 |
| 2,273,718 | A | * | 2/1942 | Morgan | 73/198 |
| 2,980,294 | A | * | 4/1961 | Sacco | 222/66 |
| 3,069,051 | A | | 12/1962 | Phillips | 222/26 |
| 3,158,736 | A | * | 11/1964 | Toth | 705/413 |
| 3,199,727 | A | * | 8/1965 | Romanowski | 222/20 |
| 3,314,289 | A | * | 4/1967 | Rodely | 73/861.34 |
| 3,319,255 | A | * | 5/1967 | Houle | 346/43 |
| RE26,410 | E | * | 6/1968 | Chanaud | 73/861.34 |
| 3,731,777 | A | | 5/1973 | Burke et al. | 194/217 |
| 3,814,148 | A | * | 6/1974 | Wostl | 141/98 |
| 3,908,718 | A | * | 9/1975 | Bower | 141/59 |
| 4,083,387 | A | * | 4/1978 | Stieber et al. | 141/95 |
| 4,654,813 | A | * | 3/1987 | Edlund et al. | 702/198 |
| 4,831,866 | A | * | 5/1989 | Forkert et al. | 73/127 |
| 5,016,187 | A | * | 5/1991 | Forkert et al. | 702/46 |
| 5,040,577 | A | * | 8/1991 | Pope | 141/59 |
| 5,042,582 | A | * | 8/1991 | Rajewski | 166/267 |
| 5,163,586 | A | | 11/1992 | Zinsmeyer | 222/14 |
| 5,170,671 | A | * | 12/1992 | Miau et al. | 73/861.22 |
| 5,184,309 | A | * | 2/1993 | Simpson et al. | 700/283 |
| 5,420,797 | A | * | 5/1995 | Burns | 700/232 |

* cited by examiner

*Primary Examiner*—J. Casimer Jacyna

(57) ABSTRACT

The invention relates to a method and apparatus for dispensing and metering a fluid, particularly fuel, from a plurality of fluid sources to a single or a plurality of fluid outlets. The invention uses a single meter for measuring the amount of fluid dispensed from each of the fluid outlets. Valves are used at the inlet to and outlet from the meter to control the flow of fluid from a single source to a single outlet intended to dispensing fluid from the selected source. The invention is particularly useful in a multiple grade or octane-level fuel pump or dispenser. The meter can advantageously be located near the dispensing nozzles, so that the contamination caused by using a single meter is purged after a small amount of fuel is dispensed. The invention preferably uses a small-volume meter with valves located near the meter, to thereby limit the amount of octane variation caused by use of a single meter.

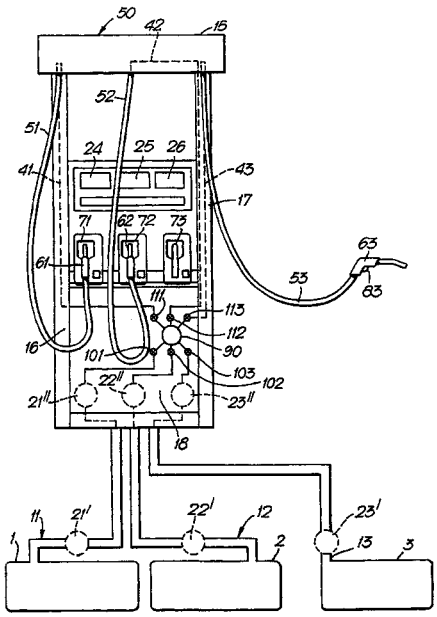

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 26, 27 and 30 is confirmed.

Claims 1–9, 11–25, 28 and 29 are cancelled.

Claim 10 is determined to be patentable as amended.

New claims 31–69 are added and determined to be patentable.

10. [The] *An* apparatus [of claim 6, further] *for dispensing fuel* comprising:

*a plurality of fluid sources;*

*at least one fuel discharge nozzle;*

*a meter, each of said plurality of fuel sources being in fluid communication with said meter and said at least one fuel discharge nozzle being in fluid communication with said meter, said meter measuring the amount of fuel discharged through said at least one fuel discharging nozzle;*

*a plurality of valves, said plurality of valves controlling a flow of fuel from said plurality of fuel sources to said at least one fuel discharge nozzle; and*

*a controlling device, said controlling device controlling said plurality of valves whereby said flow of fuel comprises flow from only one of said plurality of fuel sources and to only said at least one fuel discharge nozzle; and* a housing unit, said housing unit comprising *a lower structure,* an upper structure, said meter being located in said upper structure.

*31. A fuel dispenser for dispensing fuel to a vehicle, comprising:*

*a plurality of fuel sources;*

*at least one fuel outlet;*

*an inferential meter wherein each of said plurality of fuel sources is in fluid communication with said inferential meter and wherein said inferential meter measures the amount of fuel discharged through said at least one fuel outlet;*

*a plurality of inlet valves fluidly coupled to said inferential meter, said plurality of valves controlling a flow of fuel from said plurality of fuel sources through said inferential meter to said at least one fuel outlet;*

*a controlling device, said controlling device controlling said plurality of inlet valves whereby said flow of fuel comprises flow from only one of said plurality of fuel souces and to only said at least one fuel outlet;*

*said inferential meter is a small volume meter to reduce the amount of contamination left resident in said inferential meter after fueling the vehicle; and*

*a housing unit that comprises a lower structure and an upper structure wherein said at least one fuel outlet extends from and outside said upper structure and wherein said inferential meter is contained in said upper structure adjacent to said at least one fuel outlet to further minimize the amount of contamination between said inferential meter and said at least one fuel outlet.*

*32. A fuel dispenser for dispensing fuel to a vehicle, comprising:*

*a plurality of fuel sources;*

*at least one fuel outlet;*

*an inferential meter wherein each of said plurality of fuel sources is in fluid communication with said inferential meter, and wherein said inferential meter measures the amount of fuel discharged through said at least one fuel outlet;*

*a plurality of inlet valves, said plurality of valves controlling a flow of fuel from said plurality of fuel sources through said inferential meter to said at least one fuel outlet;*

*a controlling device, said controlling device controlling said plurality of inlet valves whereby said flow of fuel comprises flow from only one of said plurality of fuel sources and to only said at least one fuel outlet;*

*said inferential meter is a small volume meter to reduce the amount of contamination left resident in said inferential meter after fueling the vehicle; and*

*a plurality of outlet valves located between said inferential meter and said at least one fuel outlet wherein said plurality of outlet valves are under control of said controlling device to direct fuel to said at least one fuel outlet.*

*33. A fuel dispenser for dispensing fuel to a vehicle, comprising:*

*a plurality of fuel sources;*

*at least one fuel outlet;*

*an inferential meter wherein each of said plurality of fuel sources is in fluid communication with said inferential meter, and wherein said inferential meter measures the amount of fuel discharged through said at least one fuel outlet;*

*a plurality of inlet valves, said plurality of valves controlling a flow of fuel from said plurality of fuel sources through said inferential meter to said at least one fuel outlet;*

*a controlling device, said controlling device conrolling said plurality of inlet valves whereby said flow of fuel comprises flow from only one of said plurality of fuel sources and to only said at least one fuel outlet; and*

*a plurality of outlet valves located between said inferential meter and said at least one fuel outlet to direct fuel to said at least one fuel outlet.*

*34. The fuel dispenser of claim 33, wherein said at least one fuel outlet is comprised of a plurality of fuel outlets and said controlling device opens one of said plurality of outlet valves to direct the fuel flow to the desired outlet of said plurality of fuel outlets.*

*35. The fuel dispenser of claim 34, wherein said plurality of fuel sources is comprised of three fuel sources and said plurality of fuel outlets is comprised of three fuel outlets wherein said controlling device is adapted to allow fuel from any one of said three fuel sources to be discharged through said inferential meter to one of said plurality of fuel outlets.*

*36. The fuel dispenser of claim 35, wherein each of said plurality of fuel outlets is comprised of a hose and nozzle combination.*

*37. The fuel dispenser of claim 34, wherein each of said at least one fuel outlet is comprised of a hose and nozzle combination.*

*38. A fuel dispenser for dispensing fuel to a vehicle, comprising:*

*a plurality of fuel sources;*

*at least one fuel outlet;*

*an inferential meter wherein each of said plurality of fuel sources is in fluid communication with said inferential meter and wherein said inferential meter measures the amount of fuel discharged through said at least one fuel outlet;*

*a plurality of inlet valves, said plurality of valves controlling a flow of fuel from said plurality of fuel sources through said inferential meter to said at least one fuel outlet;*

*a controlling device, said controlling device controlling said plurality of inlet valves whereby said flow of fuel comprises flow from only one of said plurality of fuel sources and to only said at least one fuel outlet; and*

*a housing unit that comprises a lower structure and an upper structure wherein said at least one fuel outlet extends from and outside said upper structure and wherein said inferential meter is contained in said upper structure adjacent to said at least one fuel outlet to minimize contamination between said inferential meter and said at least one fuel outlet.*

*39. A fuel dispenser for dispensing fuel to a vehicle, comprising:*

*a plurality of fuel sources;*

*at least one fuel outlet;*

*a meter, each of said plurality of fuel sources being in fluid communication with said meter, said meter measuring the amount of fuel discharged through said at least one fuel outlet;*

*a plurality of inlet valves coupled to and located adjacent said meter wherein, said plurality of valves controlling a flow of fuel from said plurality of fuel sources through said meter to said at least one fuel outlet;*

*a controlling device, said controlling device controlling said plurality of inlet valves whereby said flow of fuel comprises flow from only one of said plurality of fuel sources and to only said at least one fuel outlet; and*

*a plurality of outlet valves located between said meter and said at least one fuel outlet wherein said plurality of outlet valves are under control of said controlling device to direct fuel to only said at least one fuel outlet.*

*40. The fuel dispenser of claim 39, wherein said at least one fuel outlet is comprised of a plurality of fuel outlets and said controlling device opens one of said plurality of outlet valves to direct the fuel flow to the desired outlet of said plurality of fuel outlets.*

*41. The fuel dispenser of claim 40, wherein said plurality of fuel sources is comprised of three fuel sources and said plurality of fuel outlets is comprised of three fuel outlets wherein said controlling device is adapted to allow fuel from any one of said three fuel outlets to be discharged through said inferential meter to one of said plurality of fuel outlets.*

*42. The fuel dispenser of claim 40, wherein each of said plurality of fuel outlets is comprised of a hose and nozzle combination.*

*43. A fuel dispenser for dispensing fuel to a vehicle, comprising:*

*a plurality of fuel sources;*

*at least one fuel outlet;*

*a meter, each of said plurality of fuel sources being in fluid communication with said meter, said meter measuring the amount of fuel discharged through said at least one fuel outlet;*

*a plurality of inlet valves coupled to and located adjacent said meter, said plurality of inlet valves controlling a flow of fuel from said plurality of fuel sources through said meter to said at least one fuel outlet;*

*a controlling device, said controlling device controlling said plurality of inlet valves whereby said flow of fuel comprises flow from only one of said plurality of fuel sources and to only said at least one fuel outlet; and*

*a housing unit that comprises a lower structure and an upper structure wherein said at least one fuel outlet extends from and outside said upper structure and wherein said meter is contained in said upper structure adjacent said at least one fuel outlet to minimize the contamination between said meter and said at least one fuel outlet.*

*44. A fuel dispenser for dispensing fuel to a vehicle, comprising:*

*a plurality of fuel sources;*

*a plurality of fuel outlets;*

*a meter, each of said plurality of fuel sources being in fluid communication with said meter, said meter measuring the amount of fuel discharged through said plurality of fuel outlets;*

*a plurality of outlet valves located between said meter and said plurality of fuel outlets wherein each of said plurality of outlet valves corresponds with each of said plurality of a fuel outlets, said plurality of outlet valves controlling a flow of fuel from said plurality of fuel sources through said meter to said plurality of fuel outlets; and*

*a controlling device, said controlling device controlling said plurality of outlet valves whereby said flow of fuel comprises flow from only one of said plurality of fuel sources and to only one of said plurality of fuel outlets.*

*45. The fuel dispenser of claim 44, wherein said plurality of fuel outlets is comprised of three fuel outlets and said plurality of outlet valves is comprised of three outlet valves.*

*46. The fuel dispenser of claim 45, wherein each of said three fuel outlets is comprised of a hose and nozzle combination.*

*47. The fuel dispenser of claim 44, wherein said meter is comprised from the group consisting of an inferential meter and a positive displacement meter.*

*48. The fuel dispenser of claim 44, further comprising a housing unit that comprises a lower structure and an upper structure wherein said plurality of fuel outlets extends from and outside said upper structure and wherein said meter is contained in said upper structure adjacent said plurality of fuel outlets to minimize the contamination between said meter and said plurality of fuel outlets.*

*49. The fuel dispenser of claim 44, further comprising a plurality of inlet valves located adjacent said meter and in fluid communication with said plurality of said fuel sources and said meter wherein said controlling device controls said plurality of inlet valves to provide fuel from one of said plurality of fuel sources to said meter to be discharged through one of said plurality of fuel outlets.*

*50. A fuel dispenser for dispensing fuel having a reduced contamination to a vehicle, comprising:*

*a plurality of fuel sources;*

*at least one fuel outlet;*

*a meter, each of said plurality of fuel sources being in fluid communication with said meter, said meter measuring the amount of fuel discharged through said at least one fuel outlet;*

*a plurality of valves, said plurality of valves controlling a flow of fuel from said plurality of fuel sources through said meter to said at least one fuel outlet;*

*a controlling device, said controlling device controlling said plurality of valves whereby said flow of fuel comprises flow from only one of said plurality of fuel sources and to only said at least one fuel outlet; and*

*a housing unit that is comprised of a lower structure and an upper structure wherein said at least one fuel outlet extends from and outside said upper structure and wherein said meter is contained in said upper structure adjacent said at least one fuel outlet to allow fuel contamination in said meter to be purged from said at least one fuel outlet after only a small volume of fuel has been dispensed.*

*51. The fuel dispenser of claim 50, wherein said meter is comprised from the group consisting of an inferential meter and a positive displacement meter.*

*52. The fuel dispenser of claim 50, further comprising a plurality of outlet valves located between said meter and said at least one fuel outlet wherein said plurality of outlet valves are under control of said controlling device to direct fuel to said at least one fuel outlet.*

*53. The fuel dispenser of claim 50, further comprising a plurality of outlet valves located between said meter and said at least one fuel outlet to direct fuel to said at least one fuel outlet.*

*54. The fuel dispenser of claim 53, wherein said at least one fuel outlet is comprised of a plurality of fuel outlets and said controlling device opens one of said plurality of outlet valves to direct the fuel flow to the desired outlet of said plurality of fuel outlets.*

*55. The fuel dispenser of claim 54, wherein said plurality of fuel sources is comprised of three fuel sources and said plurality of fuel outlets is comprised of three fuel outlets and wherein said controlling device is adapted to allow fuel from any one of said three fuel outlets to be discharged through said meter to one of said plurality of fuel outlets.*

*56. The fuel dispenser of claim 54, wherein each of said plurality of fuel outlets is comprised of a hose and nozzle combination.*

*57. The fuel dispenser of claim 50, wherein each of said at least one fuel outlet is comprised of a hose and nozzle combination.*

*58. The fuel dispenser of claim 50, wherein said at least one fuel outlet is comprised of a single fuel outlet that receives and discharges fuel from each of said plurality of fuel sources.*

*59. The fuel dispenser of claim 50, wherein said plurality of fuel sources is comprised of three fuel sources each having different octane levels.*

*60. A fuel dispenser for dispensing fuel to a vehicle, comprising:*

*a plurality of fuel sources;*

*a housing unit comprising a first side and a second side forming two different fueling positions;*

*at least one first fuel outlet located on said first side;*

*at least one second fuel outlet located on said second side;*

*a first meter located on said first side, each of said plurality of fuel sources being in fluid communication with said first meter, said first meter measuring the amount of fuel discharged through said at least one first fuel outlet;*

*a second meter located on said second side, each of said plurality of fuel sources being in fluid communication with said second meter, said second meter measuring the amount of fuel discharged through said at least one second fuel outlet;*

*a first plurality of valves, said first plurality of valves controlling a flow of fuel from said plurality of fuel sources through said first meter to said at least one first fuel outlet;*

*a second plurality of valves, said second plurality of valves controlling a flow of fuel from said plurality of fuel sources through said second meter to said at least one second fuel outlet;*

*a controlling device, said controlling device controlling said first plurality of valves whereby said flow of fuel comprises flow from only one of said plurality of fuel sources and to only said at least one first fuel outlet, and said controlling device controlling said second plurality of valves whereby said flow of fuel comprises flow from only one of said plurality of fuel sources and to only said at least one second fuel outlet.*

*61. The fuel dispenser of claim 60, wherein said first meter and said second meter are comprised from the group consisting of an inferential meter and a positive displacement meter.*

*62. The fuel dispenser of claim 61, wherein said housing unit further comprises a lower structure and an upper structure wherein said at least one first fuel outlet extends from and outside said upper structure on said first side and wherein said at least one second fuel outlet extends from and outside said upper structure on said second side and wherein said first meter is contained in said upper structure adjacent said at least one first fuel outlet and said second meter is contained in said upper structure adjacent said at least one second fuel outlet to minimize the amount of contamination between said first meter and said at least one first fuel outlet and said second meter and said at least one second fuel outlet.*

*63. The fuel dispenser of claim 60, wherein said plurality of fuel sources is comprised of three fuel sources and said at least one first plurality of fuel outlets is comprised of a first three fuel outlets and said at least one second plurality of fuel outlets is comprised of a second three fuel outlets wherein said controlling device is adapted to allow fuel from one of said three fuel sources to be discharged through said first meter to one of said first three fuel outlets and wherein said controlling device is adapted to allow fuel from only one of said three fuel sources to be discharged through said second meter to only one of said second three fuel outlets.*

*64. The fuel dispenser of claim 60, wherein said at least one first fuel outlet is comprised of a hose and nozzle combination and said at least one second fuel outlet is comprised of a hose and nozzle combination.*

*65. The fuel dispenser of claim 60, wherein said at least one first fuel outlet is comprised of a single fuel outlet that receives and discharges fuel from only one of said plurality of fuel sources and said at least one second fuel outlet is comprised of a single fuel outlet that receives and discharges fuel from only one of said plurality of fuel sources.*

*66. The fuel dispenser of claim 60, wherein said plurality of fuel sources is comprised of three fuel sources each having different octane levels.*

*67. A method for dispensing fuel comprising the steps of:*

*providing a plurality of fuel sources;*

*providing at least one fuel discharge nozzle;*

*extracting fuel from said plurality of fuel sources;*

*passing all fuel extracted from each of said plurality of sources through a single meter;*

*dispensing fuel passed through said meter from said at least one fuel discharge nozzle;*

*providing at least one second fuel discharge nozzle, said at least one second fuel discharge nozzle discharging fuel from only one of said fuel sources;*

*providing a housing unit;*

*locating said at least one fuel discharge nozzle on a first side of said housing unit and locating said at least one second fuel discharge nozzle on a second side of said housing unit;*

*extracting fuel from said plurality of fuel sources;*

*passing fuel extracted from each of said second plurality of sources through a second meter; and*

*dispensing fuel passed through said second meter from said at least one second discharge nozzle.*

*68. A method for dispensing fuel comprising the steps of:*

*providing a plurality of fuel sources;*

*providing at least one fuel discharge nozzle and at least one second fuel discharge nozzle;*

*providing a housing unit;*

*locating said at least one fuel discharge nozzle on a first side of said housing unit and locating said at least one second fuel discharge nozzle on a second side of said housing unit;*

*extracting fuel from said plurality of fuel sources;*

*passing all fuel extracted from each of said plurality of sources through either a first meter or a second meter; and*

*dispensing fuel passed through said first meter from said at least one fuel discharge nozzle and dispensing all fuel passed through said second meter from said at least one second fuel discharge nozzle.*

*69. The method of claim 68, wherein*

*said step of providing at least one fuel discharge nozzle comprises providing a plurality of fuel discharge nozzles, each of said plurality of fuel discharge nozzles discharging fuel from only one of said fuel sources; and further comprising the step of controlling a flow of fuel from said fuel sources such that fuel extracted from one of said fuel sources is dispensed at only one of said fuel discharge nozzles; and*

*wherein said step of providing at least one second fuel discharge nozzle comprises providing a plurality of, second fuel discharge nozzles, each of said plurality of second fuel discharge nozzles discharging fuel from only one of said fuel sources; and further comprising the step of controlling a flow of fuel from said fuel sources such that fuel extracted from one of said fuel sources is dispensed at only one of said second fuel discharge nozzles.*

* * * * *